US007874272B2

(12) United States Patent
Schnell et al.

(10) Patent No.: US 7,874,272 B2
(45) Date of Patent: Jan. 25, 2011

(54) METHOD OF VARIABLE VALVE TIMING IN AN INTERNAL COMBUSTION ENGINE

(75) Inventors: Oliver Schnell, Veitsbronn (DE); Peter Sailer, Erlangen (DE); Martin Scheidt, Herzogenaurach (DE)

(73) Assignee: Schaeffler KG, Herzogenaurach (DE)

( * ) Notice: Subject to any disclaimer, the term of this patent is extended or adjusted under 35 U.S.C. 154(b) by 421 days.

(21) Appl. No.: 12/084,807

(22) PCT Filed: Oct. 25, 2006

(86) PCT No.: PCT/EP2006/067756

§ 371 (c)(1),
(2), (4) Date: May 27, 2008

(87) PCT Pub. No.: WO2007/054430

PCT Pub. Date: May 18, 2007

(65) Prior Publication Data

US 2009/0255495 A1 Oct. 15, 2009

(30) Foreign Application Priority Data

Nov. 12, 2005 (DE) ..... 10 2005 054 115

(51) Int. Cl.
*F01L 1/34* (2006.01)

(52) U.S. Cl. ..... 123/90.15; 123/90.12; 123/90.17; 123/90.52

(58) Field of Classification Search ..... 123/90.12, 123/90.15, 90.17, 90.45, 90.46, 90.52, 90.55, 123/339.1, 347, 406.23, 406.35
See application file for complete search history.

(56) References Cited

U.S. PATENT DOCUMENTS

| | | | | |
|---|---|---|---|---|
| 4,054,109 | A | 10/1977 | Herrin | |
| 4,491,098 | A | 1/1985 | Rotondo | |
| 5,758,613 | A | 6/1998 | Edelmayer | |
| 7,296,549 | B1 * | 11/2007 | Sailer et al. | 123/90.52 |

FOREIGN PATENT DOCUMENTS

| | | |
|---|---|---|
| EP | 0 945 598 A2 | 9/1999 |
| JP | 61 185607 | 8/1986 |

* cited by examiner

*Primary Examiner*—Ching Chang
(74) *Attorney, Agent, or Firm*—Charles A. Muserlian

(57) ABSTRACT

A method of variable valve timing in an internal combustion engine in which the valve opening and closing timing of the actuated gas exchange valves of the internal combustion engine can be varied as a function of engine speed by adjusting means for adjusting at least one camshaft relative to a crankshaft, said internal combustion engine comprising hydraulic valve lash adjusters for adjusting a valve lash of the gas exchange valves, said lash adjusters being configured at least on one of an inlet side and an outlet side as idle stroke elements which, when actuated, at first produce an engine speed-dependent idle stroke and to provide a method of variable valve timing for internal combustion engines comprising a camshaft adjustment and a hydraulic valve adjustment with an idle stroke function that guarantees favorable valve timing in all operational situations of the internal combustion engine and, at the same time, improves the thermodynamic exploitation of such internal combustion engines, at each adjustment of the at least one camshaft, the respective idle stroke of the valve lash adjusters is taken into account.

7 Claims, 3 Drawing Sheets

METHOD OF VARIABLE VALVE TIMING IN AN INTERNAL COMBUSTION ENGINE

FIELD OF THE INVENTION

The invention concerns a method of variable valve timing in an internal combustion engine in which the valve opening and closing timing of the actuated gas exchange valves of the internal combustion engine can be varied as a function of the engine speed by adjusting means for adjusting at least one camshaft relative to a crankshaft, said internal combustion engine comprising hydraulic valve lash adjusters for adjusting a valve lash of the gas exchange valves, said lash adjusters being configured at least on one of an inlet side and an outlet side as idle stroke elements which, when actuated, at first produce an engine speed-dependent idle stroke.

BACKGROUND OF THE INVENTION

Camshaft adjusters for varying the valve opening and closing timing of the gas exchange valves in internal combustion engines, particularly in automotive vehicles, are known per se. By the variation of valve timing it is intended to optimize different operating parameters, particularly engine torque, idle stroke quality, fuel consumption as well as pollutant emission as a function of the engine speed.

In engines comprising an inlet camshaft and an outlet camshaft, for example in the DOHC (double overhead camshaft) engine having two overhead camshafts, the outlet and inlet operations can be adjusted relative to each other as a function of the engine speed by camshaft adjusters mostly configured as electrohydraulic adjusters. For this purpose, it is generally the inlet camshaft that is adjusted through a certain angle relative to the crankshaft through which both camshafts are driven. In the region of the upper gas exchange dead point, this causes a variation of the overlap of the inlet and outlet operations during which both inlet and outlet valves are open at the same time. During this overlap a scavenging process takes place in which fresh gas is fed in and residual gas is expelled. At the same time, due to backflow processes of exhaust gas, an "internal" exhaust gas recirculation that changes the residual gas mass in the compression chamber takes place. The exhaust gas recirculation reduces the combustion temperature and thus contributes to the reduction of $NO_x$ pollutant emission. On the other hand, an excessive residual gas mass leads to a deterioration of the idling quality (erratic idling behavior). Therefore, during idle running, an adjustment to a "retarded" inlet closing is executed with the help of the camshaft adjuster, so that, through a small valve overlap, the idling quality is improved or a high degree of idling quality assured.

An adjustment to retarded inlet closing is likewise performed at high engine speeds. Because of the retarded inlet closing, a vibrating air column that develops particularly at high speeds in the engine cylinder leads to a gas dynamic recharging effect in the combustion chamber that results in an enhancement of engine performance. In contrast, at medium engine speeds, the camshaft is adjusted for to an "advance" inlet closing in order to achieve a better cylinder filling that leads to a higher torque.

A camshaft adjustment, particularly with a view to reducing pollutants, can be appropriate even in engines having only one camshaft, for example in OHV (overhead valves) engines with a bottom camshaft or in SOHC (single overhead camshaft) engines with an overhead camshaft. However, due to the fact that the valve overlap remains constant, the setting of valve opening and closing timing is always a compromise.

Other known hydraulic valve lash adjusters automatically adjust a valve lash resulting from thermal expansion and wear of the transmission elements that transmit a cam lift produced by the camshaft to the gas exchange valves, so that a perfect operation of the internal combustion engine is guaranteed. These adjusting elements are generally configured as hydraulic tappets comprising a control valve that is biased in closing direction by a spring. This means that, through the force of the spring, the control valve is closed for most of the time. Thus, these lash adjusters, as quasi rigid elements, transfer a cam lift directly to the gas exchange valves.

Valve lash adjusters in which the control valve is biased in opening direction are being increasingly used. Such lash adjusters, configured, for example, as RSHVA (reverse spring hydraulic valve adjusters) or as NOLA (normally open lash adjusters) are known, for instance, from U.S. Pat. No. 4,054,109, U.S. Pat. No. 5,758,613 and JP 61 185607 A. In these lash adjusters, the control valve is held in open position during the cam base circle phase by the force of the spring. Because the lash adjuster can only be closed by hydrodynamic and hydrostatic forces arising from an oil stream flowing from a high pressure chamber to a low pressure chamber of the tappet with commencement of the cam lobe, the lash adjuster at first produces an idle stroke before the actual valve lift begins. In particular, the idle stroke reliably prevents a negative valve lash and can be put to use for compensating mechanical shortcomings, particularly in the case of camshafts in vehicles having adjustable cams and/or camshafts.

The idle stroke of such lash adjusters can influence the valve overlap and thus also the opening and closing timing of the gas exchange valves. Normally, the idle stroke is largest at the idling speed of the engine and decreases more or less linearly with rising speed. The relatively large idle stroke during idle running reduces the valve overlap, so that the quantity of residual gas formed during combustion in the cylinder combustion chamber is reduced. This has a positive effect on the idling quality of the engine with respect to a stable idling motion.

Camshaft adjusters serve to modify the valve overlap in different engine speed ranges. Idle stroke elements likewise modify the valve overlap. Disadvantageously, the thermodynamic potentials offered by camshaft adjustment and valve lash adjustment with help of the idle stroke have not been exhaustively exploited in the past. In particular, no method of variable valve timing is known so far in which an influence of hydraulic valve lash adjusters with idle stroke on the valve timing in internal combustion engines equipped with camshaft adjusters is adequately regulated. In internal combustion engines with camshaft adjustment and idle stroke elements, an offsetting of valve timing having an unfavorable effect in certain operational situations can take place.

OBJECTS OF THE INVENTION

It is an object of the invention to provide a method of variable valve timing for internal combustion engines comprising a camshaft adjustment and a hydraulic valve lash adjustment with an idle stroke function that guarantees favorable valve timing in all operational situations of the internal combustion engine and, at the same time, improves the thermodynamic exploitation of such internal combustion engines.

This and other objects and advantages of the invention will become obvious from the following detailed description.

SUMMARY OF THE INVENTION

The invention is based on the discernment that, with the idle stroke of hydraulic valve lash adjusters, an additional parameter is available that has an influence on the valve timing in the internal combustion engine and that can be deliberately included in a method of variable valve timing with the help of a camshaft adjustment with the aim of enhancing the effectiveness of the combustion process.

The starting point of the invention is therefore a method of variable valve timing in an internal combustion engine in which the valve opening and closing timing of the actuated gas exchange valves of the internal combustion engine are varied as a function of the engine speed by adjusting means for adjusting at least one camshaft relative to a crankshaft, said internal combustion engine comprising hydraulic valve lash adjusters for adjusting a valve lash of the gas exchange valves, said lash adjusters being configured at least on one of an inlet side and an outlet side as idle stroke elements which, when actuated, at first produce a speed-dependent idle stroke. The invention further provides that at each adjustment of the at least one camshaft the respective idle stroke of the valve lash adjusters is taken into account.

Advantageously, with the help of the inventive method, the functional range of the camshaft adjustment is widened. The idle stroke of RSHVAs and NOLAs is actively integrated in the control of the valve timing, particularly the valve closing timing. This enables an improved exploitation of the thermodynamic potentials of the internal combustion engine in different, significant operational conditions of the internal combustion engine, in particular, during idle running and at cold start, that is to say, at low oil temperatures.

According to a further proposition of the invention, in an internal combustion engine comprising two camshafts through which the inlet valve timing and the outlet valve timing of the gas exchange valves can be set independently of one another and in which the idle stroke of the idle stroke elements is designed for a maximum engine speed, through a resetting of the camshaft adjustment during idle running, the valve overlap does not fall below a defined minimum valve overlap value during idle running. This can advantageously be achieved by resetting the camshaft that actuates the inlet valves in direction of an advanced inlet valve opening.

In internal combustion engines with two independently adjustable camshafts (dual independent system) which have a flexible configuration, it is possible, in combination with reverse spring idle stroke elements, to design the idle stroke such that it is still adequate to compensate for camshaft displacements or flexions of the flexible camshafts through the entire engine speed range, particularly also at high engine speeds.

Because, with increasing engine speed, due to the increasing volume flow that loads the valve closing body of the control valve during valve lift and the concomitant shorter closing time of the control valve, the idle stroke of the adjuster diminishes, by inversion of the argument, the designing of the idle stroke for a maximum engine speed results in a very large idle stroke during idle running. A larger idle stroke during idle running is certainly basically desired because the resulting smaller valve overlap assures a high idling quality.

To be able to set as high a speed of the internal combustion engine as possible, under certain conditions, the idle stroke at the maximum engine speed can be designed to be so large that during the idling phase only an extremely small or no valve overlap at all is produced. This, in turn, means that no internal exhaust gas recirculation takes place any more. From the point of view of emission and consumption, however, a slight internal exhaust gas recirculation should always be maintained even during idle running.

According to another feature of the invention, this is achieved with the help of the camshaft adjuster by the fact that by resetting the camshaft, an inlet adjustment is made in direction of "advanced" inlet closing. This enables, on the one hand, an internal combustion engine with a flexible camshaft to be operated at very high engine speeds with relatively low wear and noise and, on the other hand, an acceptable residual gas content with which an adequate idling quality can be achieved and that is also favorable to consumption and pollutant discharge can be set for the idling phase.

According to still another provision of the invention, in the case of a cold start of such an internal combustion engine, through a resetting of the camshaft adjustment during idle running, a defined maximum valve overlap is not exceeded during idle running. This can advantageously be achieved by resetting the camshaft that actuates the inlet valves in direction of a retarded inlet opening.

This enables a further inventive valve timing regulation with a combination of a dual independent camshaft adjuster comprising reverse spring idle stroke elements. Due to the temperature dependence of the viscosity of the oil in the adjusting element, at very low temperatures, particularly at cold start, idle stroke elements produce only a small idle stroke and thus a rather too large valve overlap. This, in turn, leads to a relatively unstable idling motion. To compensate this, the engine idling speed could be additionally raised. However, with a view to emission, this is not desirable. This problem can be solved by the invention by a resetting of the camshaft in direction of a "retarded" inlet opening at cold start. This reduces the overlap surface and produces a good idling quality without an additional raise of the engine speed.

An improved valve timing can also be achieved in internal combustion engines comprising only one adjustable camshaft (double equal system) and idle stroke elements. According to a further provision of the invention, in the case of an internal combustion engine comprising only one camshaft through which the inlet valve timing and the outlet valve timing of the gas exchange valves can be adjusted in mutual dependence on each other, said engine comprising valve lash adjusters with idle stroke function on the inlet side and on the outlet side, a camshaft adjustment in direction of a retarded inlet and outlet closing is effected in a medium engine speed range in operative connection with an earlier inlet and outlet closing caused by the idle stroke of the gas exchange valves.

A phase adjustment from inlet to outlet is not possible in dual equal systems. The pre-set valve overlap is chosen with a view to the idling quality in the normal position and constitutes a compromise for all other speed ranges.

In the part-load range (medium engine speed), an adjustment in direction of "retard", i.e. inlet valve and outlet valve close later than in the normal position, can reduce $NO_x$ emissions. This is achieved by the fact that, due to the retarded closing of the outlet valve during the down stoke of the piston, exhaust gas reflows into the combustion chamber. This reduces the temperature of combustion and, thus, the production of $NO_x$. But, because the inlet also closes later, a part of the cylinder charge is expelled during the compression stroke, so that the degree of compression achieved falls which as a result leads to a poorer inflammation and combustion and a falling engine performance. Thus an adjustment to "too late" in a conventional dual equal system would be accompanied by considerable drawbacks.

The aim in a dual equal system is to unthrottle by a retarded closing of the inlet valve, i.e. to enable an expulsion of charge from the cylinders. The residual gas content of the charge is determined by two factors, viz., the invariable overlap (outlet valve closes while inlet valve opens) and by the camshaft adjustment-dependent offset of the overlap in direction of "retard" and thus toward higher speeds of the descending piston. As a consequence of this, it is possible that the potential unthrottling is limited by an excessive quantity of residual gas.

The use of idle stroke elements shortens the so-called overlap of valve actuation and thus reduces the residual gas content in the cylinders. In this way, a maximum retard adjustment is possible without disadvantages for the combustion procedure.

Finally, the camshaft adjustment to "retard" in a dual equal system with idle stroke elements also leads to an uncritical behavior of the system during idle running and at low loads. Whereas, in a system without idle stroke elements, a good idling quality is guaranteed in the normal position, i.e. without camshaft adjustment, an adjustment to "retard" leads to a relatively large quantity of residual gas in the idling state and in the low-load range which can result in an erratic engine operation and even to misfiring and worse exhaust gas values.

These drawbacks can be avoided in a dual equal system by utilizing the idle stroke of idle stroke elements. Due to the idle stroke, valve overlap is increasingly reduced with falling engine speed. Consequently, the quantity of residual gas is reduced and the idling quality improved again. This means that even with a "retard" adjustment at relatively low engine speeds an adequate idling quality is still assured. The inventive camshaft adjustment to "retard" then assures the advantageous, correct residual gas setting during load increase.

On the whole, by a careful weighing up of the particular, partially opposing effects in each case, and by appropriate combinations of camshaft adjustment with the idle stroke produced by the valve lash adjusters with idle stroke function, valve timings can be set that open up additional thermodynamic potentials over the entire speed range of the internal combustion engine, with advantageous effects on engine running quality and performance development with due consideration given to fuel consumption and pollutant emissions.

BRIEF DESCRIPTION OF THE DRAWINGS

The inventive method will be elucidated in the following with reference to the appended diagrams of some examples of embodiment.

DETAILED DESCRIPTION OF THE DRAWINGS

The valve timing diagrams in FIGS. 1 to 4 show valve lift patterns in which a valve lift 1 of a gas exchange valve is plotted against a crank angle 3 of a crankshaft of an internal combustion engine. The crank angle 3 serves as a measure of the progression in time of the valve lift 1 and also serves to illustrate an adjustment of the outlet and inlet timings of gas exchange valves through a camshaft adjuster.

Figure 1:
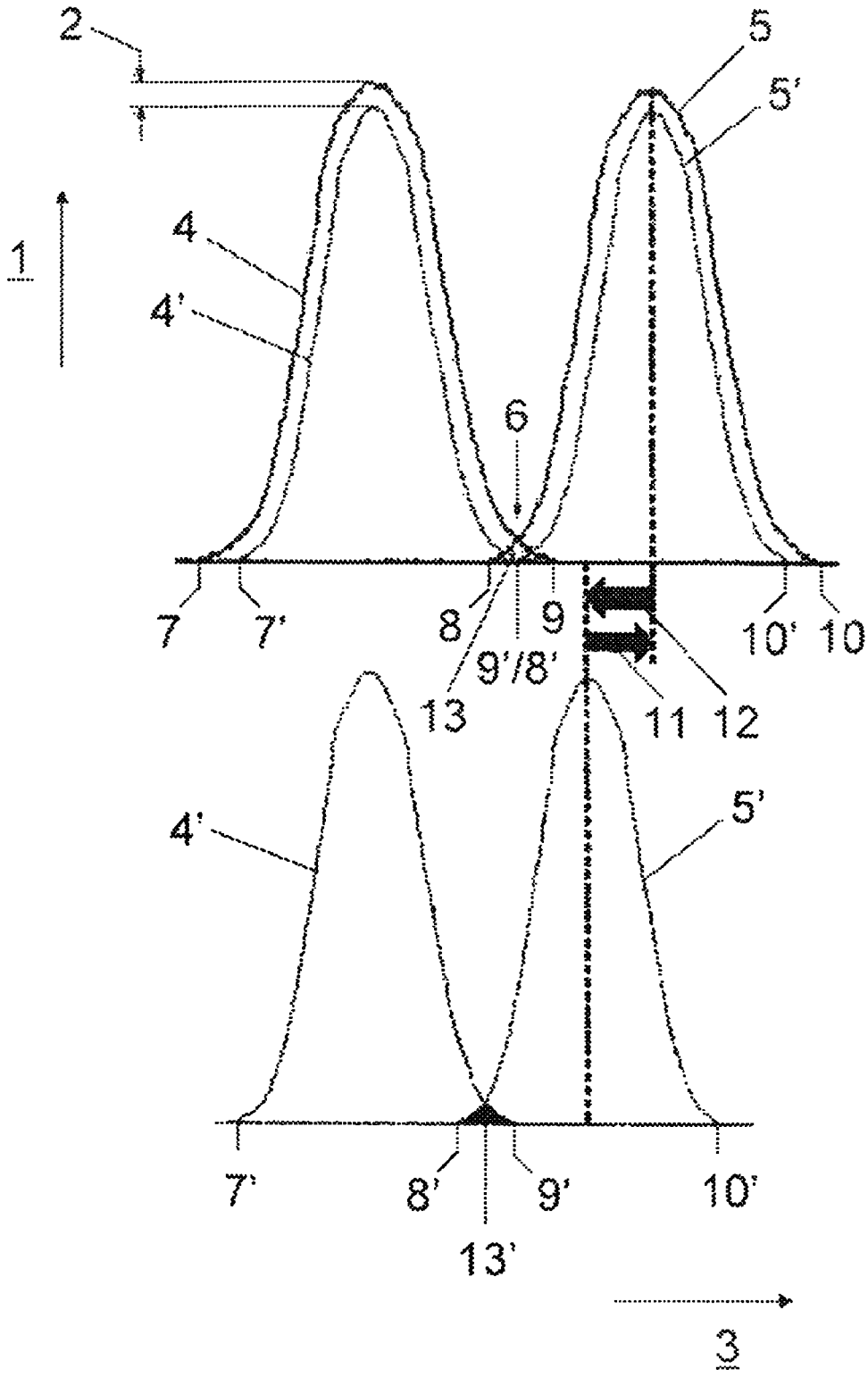
FIG. 1 is a valve timing diagram of a camshaft adjustment according to the invention in an internal combustion engine comprising two independently adjustable camshafts for inlet and outlet valves and further comprising hydraulic valve lash adjusters with an idle stroke function during idle running.

In the upper half, FIG. 1 shows an outlet curve 4 of an outlet valve and an inlet curve 5 of an inlet valve in an internal combustion engine without an idle stroke in valve lash adjustment. The curves 4' and 5' situated within the curves 4 and 5, in contrast, are outlet and inlet curves in valve lash adjustment with an idle stroke 2.

The outlet opens at a point of time (AÖ) i.e., at a respective crank angle 7 or 7' and closes at a point of time (AS) 9 or 9'. The inlet opens at a point of time (EÖ) 8 or 8' and closes at a point of time (ES) 10 or 10'. The curves 4 and 5 show the situation during idling motion without idle stroke elements. At an upper dead point 6 that is situated in the range of a load alternation, the outlet and the inlet are open at the same time. This results in a certain valve overlap 13 (surface or angle of overlap in an initial state).

In the case of the inlet and outlet curves 4' and 5' with idle stroke elements, the idle stroke 2 for the compensation of camshaft displacements or camshaft deformations is designed for a maximum engine speed. This leads to a very large idle stroke 2 during idle running. As a result, the valve overlap 13 is diminished to the extent that it no longer exists.

To prevent this, the inlet camshaft 12 is adjusted in direction 12 of an "advance" inlet closing. This is illustrated in the lower half of FIG. 1. During this time, the outlet camshaft is held in place. As a result, due to the resetting of the camshaft, a slight valve overlap 13' is again achieved (surface or angle of overlap in a final state.) that makes available an acceptable quantity of residual gas for an adequate idle stroke quality and thus leads to an advantageous compromise between exhaust gas emission and consumption as well as stable idling.

Figure 2:
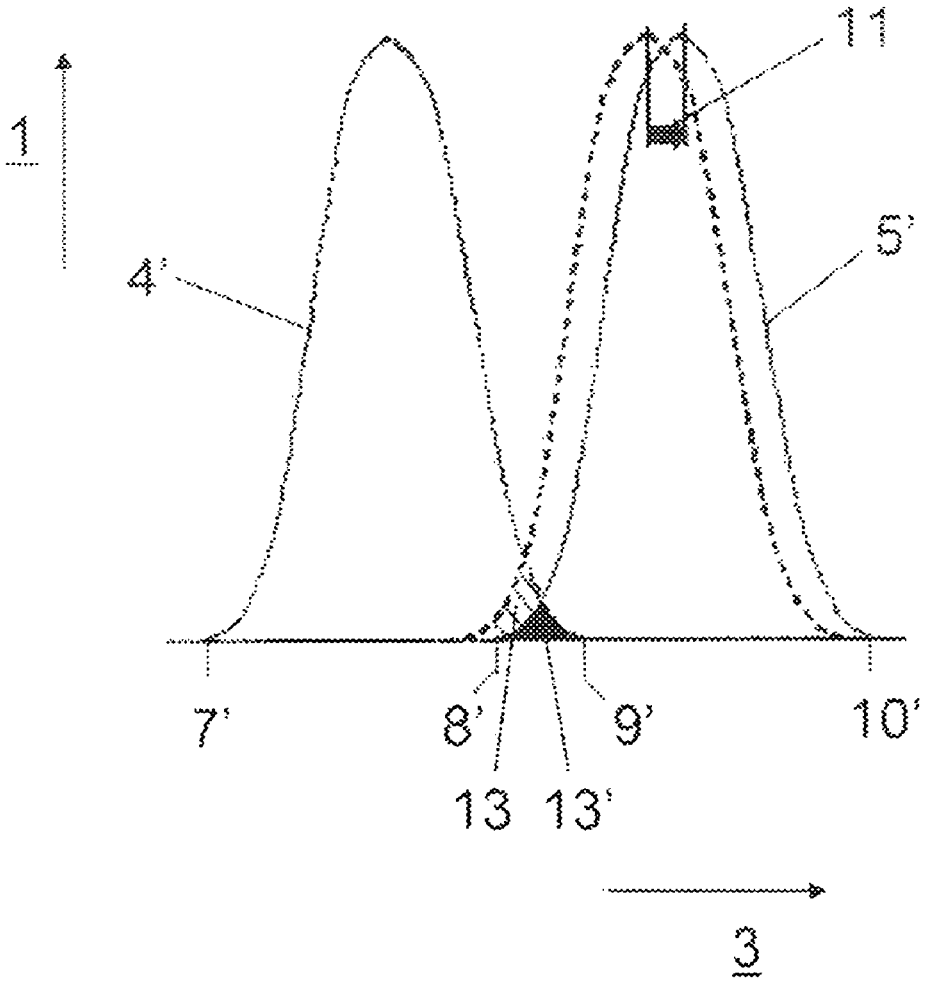
FIG. 2 is a corresponding valve timing diagram for a cold start.

FIG. 2 shows the operation situation at a cold start. Due to a low oil temperature, the idle stroke of the idle stroke elements during idle running is very small. At the beginning, a relatively large valve overlap 13 is formed with the (unadjusted) inlet curve that is indicated in broken lines. At this moment, there is a large quantity of residual gas in the cylinder, so that the idling quality is poor. By an adjustment in direction 11, i.e. toward "retard", the initial valve overlap 13 is reduced to a smaller final valve overlap 13', so that the idling quality is again improved. A raising of the idling speed is thus rendered superfluous.

Figure 3:
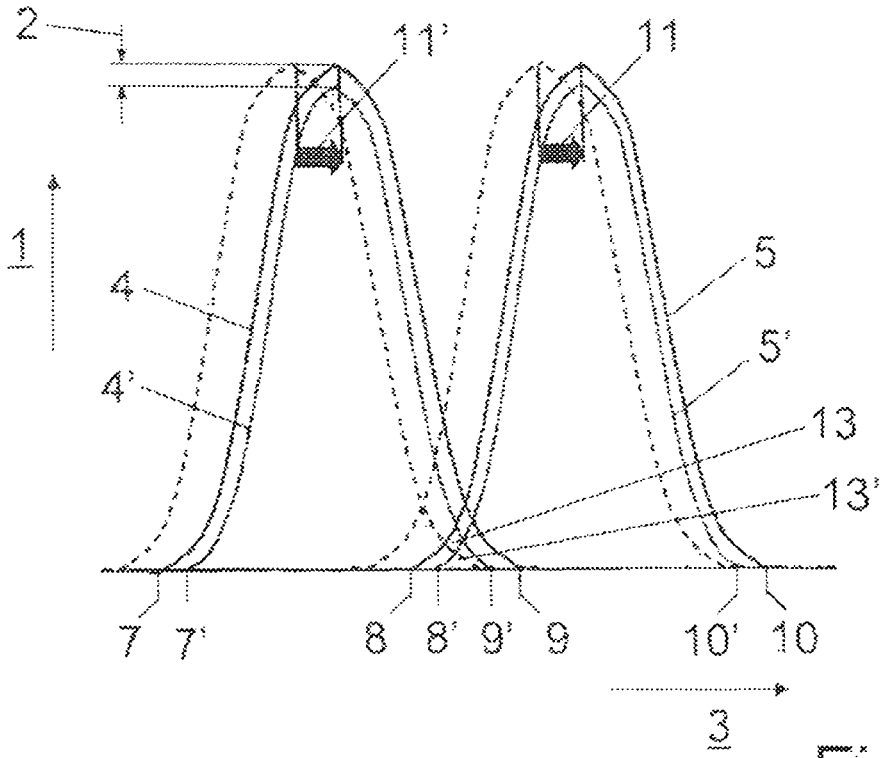
FIG. 3 is a valve timing diagram of a camshaft adjustment according to the invention in an internal combustion engine comprising one adjustable camshaft for inlet and outlet valves and further comprising hydraulic valve lash adjusters with an idle stroke function on the inlet side and on the outlet side, at medium engine speeds.

FIG. 3 shows an operation situation at a medium engine speed in an internal combustion engine having only one camshaft. An adjustment of the outlet toward "retarded" closing 11' has the effect that during its downward movement the piston allows additional exhaust gas to enter the compression chamber. Due to this increase of residual gas, the temperature of combustion in the cylinder sinks, so that nitrogen oxide ($NO_x$) emission is reduced. During the compression stroke of the engine, the simultaneously closing inlet expels charge out of the cylinder so that the inflammability of the fuel-air mixture deteriorates thus leading to a loss of performance of the engine.

The valve lift curves 4 and 5 show the retard adjustment without idle stroke elements. For the purpose of comparison, the curves prior to adjustment are indicated in broken lines in FIG. 3. With idle stroke elements on the inlet side and on the outlet side, the lift curves 4' and 5' are obtained after the retard adjustment. As a result of the idle stroke 2, the closing of both the outlet and of the inlet takes place earlier. The outlet now closes already at 9' instead of at 9 and the inlet closes already at 10' instead of at 10. This does indeed lead to a reduction of the overlap surface 13 compared to the overlap surface 13' and thus also of the additional residual gas and pollutant reduction. Through the earlier inlet closing, however, the unfavorable consequences of the adjustment of the inlet side toward "retard" are partially compensated for, i.e. the performance loss is reduced.

Figure 4:
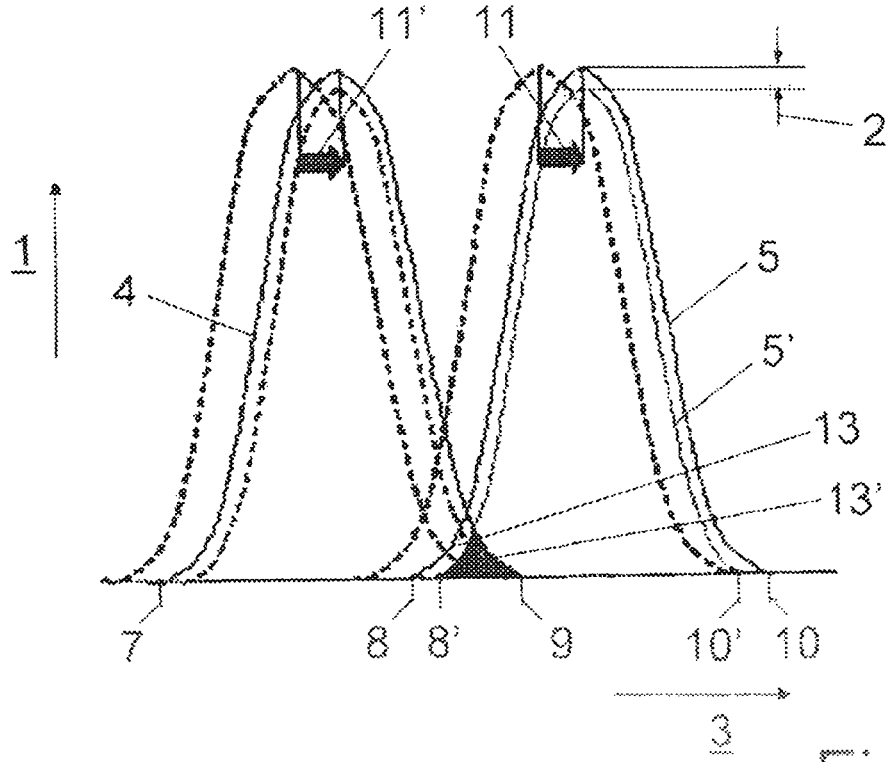
FIG. 4 is a corresponding valve timing diagram of an internal combustion engine comprising idle stroke elements only on the inlet side.

Finally, FIG. 4 shows a camshaft retard adjustment that is comparable to the example of FIG. 3, idle stroke elements, however, being arranged only on the inlet. The resulting overlap surface 13' in this case remains larger in comparison to the overlap surface 13' of FIG. 3 and approximately as large as the overlap surface 13 without idle stroke elements. Accordingly, approximately the same pollutant reduction is achieved as without idle stroke elements and, still, at the same time, the performance loss is limited to the same extent as in the example of FIG. 3.

REFERENCE NUMERALS

1 Valve lift
2 Idle stroke
3 Crank angle
4 Outlet curve without idle stroke
4' Outlet curve with idle stroke
5 Inlet curve without idle stroke
5' Inlet curve with idle stroke
6 Upper dead point (gas exchange)
7 Outlet opens (AÖ) without idle stroke
7' Outlet opens (AÖ) with idle stroke
8 Inlet opens (EÖ) without idle stroke
8' Inlet opens (EÖ) with idle stroke
9 Outlet closes (AS) without idle stroke
9' Outlet closes (AS) with idle stroke
10 Inlet closes (ES) without idle stroke
10' Inlet closes (ES) with idle stroke
11 Inlet adjustment "retard"
11' Outlet adjustment "retard"
12 Inlet adjustment "advance"
13 Valve overlap initial position
13' Valve overlap final position

The invention claimed is:

1. A method of variable valve timing in an internal combustion engine in which a valve opening and closing timing of actuated gas exchange valves of the internal combustion engine can be varied as a function of engine speed by adjusting means for adjusting at least one camshaft relative to a crankshaft, said internal combustion engine comprising hydraulic valve lash adjusters for adjusting a valve lash of the gas exchange valves, said lash adjusters being configured at least on one of an inlet side and an outlet side as idle stroke elements which, when actuated, at first produce an engine speed-dependent idle stroke wherein, at each adjustment of the at least one camshaft, a respective idle stroke of the valve lash adjusters is taken into account.

2. A method of claim 1, wherein in an internal combustion engine comprising two camshafts through which an inlet valve timing and an outlet valve timing of the gas exchange valves can be set independently of one another and in which the idle stroke of the idle stroke elements is designed for a maximum engine speed, through a resetting of the camshaft adjustment during idle running, the valve overlap does not fall below a defined minimum valve overlap value during idle running.

3. A method of claim 2, wherein the camshaft actuating the inlet valves is reset in direction of an advanced inlet opening.

4. A method of claim 1 wherein, at cold start of an internal combustion engine comprising two camshafts through which the inlet valve timing and the outlet valve timing of the gas exchange valves can be set independently of one another, through a resetting of the camshaft adjustment during idle running, a defined maximum valve overlap is not exceeded during idle running.

5. A method of claim 4, wherein the camshaft actuating the inlet valves is reset in direction of a retarded inlet opening.

6. A method of claim 1, wherein in an internal combustion engine comprising only one camshaft through which the inlet valve timing and the outlet valve timing of the gas exchange valves can be adjusted in mutual dependence on each other, said engine comprising valve lash adjusters with idle stroke function on the inlet side and on the outlet side, a camshaft adjustment in direction of a retarded inlet and outlet closing is effected in a medium engine speed range in operative connection with an earlier inlet and outlet closing caused by the idle stroke of the gas exchange valves.

7. A method of claim 1, wherein in an internal combustion engine comprising only one camshaft through which the inlet valve timing and the outlet valve timing of the gas exchange valves can be adjusted in mutual dependence on each other, said engine comprising valve lash adjusters with idle stroke function only on the inlet side, a camshaft adjustment in direction of a retarded inlet and outlet closing is effected in a medium engine speed range in operative connection with an earlier inlet and outlet closing caused by the idle stroke of the gas exchange valves.

* * * * *